US010131529B2

(12) United States Patent
Jersey et al.

(10) Patent No.: US 10,131,529 B2
(45) **Date of Patent: *Nov. 20, 2018**

(54) MODULAR DISPENSING SYSTEM

(71) Applicant: PepsiCo, Inc., Purchase, NY (US)

(72) Inventors: Steven T. Jersey, Laguna Niguel, CA (US); William W. Segiet, Bethel, CT (US); Tom Siegel, Purchase, NY (US); Eddie Kali, Marietta, GA (US); Joseph H. Boggs, Newton, CT (US); Robert Balstad, New Milford, CT (US)

(73) Assignee: PepsiCo, Inc., Purchase, NY (US)

( * ) Notice: Subject to any disclaimer, the term of this patent is extended or adjusted under 35 U.S.C. 154(b) by 180 days.

This patent is subject to a terminal disclaimer.

(21) Appl. No.: 14/627,062

(22) Filed: Feb. 20, 2015

(65) Prior Publication Data

US 2015/0158712 A1 Jun. 11, 2015

Related U.S. Application Data

(63) Continuation of application No. 13/116,247, filed on May 26, 2011.

(51) Int. Cl.
*B67D 7/80* (2010.01)
*B67D 1/00* (2006.01)
(Continued)

(52) U.S. Cl.
CPC ..... *B67D 1/0037* (2013.01); *B67D 1/0016* (2013.01); *B67D 1/0021* (2013.01);
(Continued)

(58) Field of Classification Search
CPC ..... B67D 1/0021; B67D 1/0084; B67D 2210/00034; B67D 1/0857; B67D 1/0041;
(Continued)

(56) References Cited

U.S. PATENT DOCUMENTS 1,351,133 A 8/1920 Scharwath
1,408,397 A 2/1922 Ragsdale
(Continued)

FOREIGN PATENT DOCUMENTS

CA 2501127 A1 10/2005
CA 2582130 A1 9/2007
(Continued)

OTHER PUBLICATIONS

International Search Report and Written Opinion dated Nov. 14, 2012, received in International Patent Application No. PCT/US2012/036116, filed May 2, 2012.

*Primary Examiner* — Patrick M Buechner
*Assistant Examiner* — Michael J Melaragno
(74) *Attorney, Agent, or Firm* — Sterne, Kessler, Goldstein & Fox P.L.L.C.

(57) ABSTRACT

The disclosure concerns a system including a modular dispensing system, at least one dispensing head at a counter, a transfer unit located remotely from the counter, and piping extending from the transfer unit to the counter. In one aspect, the transfer unit comprises a centralized flavor ingredient system having a plurality of beverage flavor ingredient sources, and the piping comprises a main micro bundle.

24 Claims, 12 Drawing Sheets

(51) Int. Cl.
*B67D 1/06* (2006.01)
*B67D 1/08* (2006.01)
*F25C 5/20* (2018.01)

(52) U.S. Cl.
CPC ..... *B67D 1/0041* (2013.01); *B67D 1/0081* (2013.01); *B67D 1/06* (2013.01); *B67D 1/0857* (2013.01); *F25C 5/20* (2018.01); *B67D 2210/00049* (2013.01)

(58) Field of Classification Search
CPC ..... B67D 1/06; B67D 1/0031; B67D 1/0043; B67D 1/0037; B67D 1/0046; B67D 1/0081; B67D 1/0865; B67D 1/0867; B01F 3/04531; B01F 3/0853
USPC ..... 222/129.1, 129–130, 144.5, 146.1, 222/129.3–129.4, 145.5; 62/3.63, 389, 62/390; 426/590
See application file for complete search history.

(56) References Cited

U.S. PATENT DOCUMENTS 2,140,816 A 12/1938 Seitz
2,462,019 A 2/1949 Bowman
2,598,751 A 6/1952 Berkowitz et al.
2,680,455 A 6/1954 Raiteri
2,682,984 A 7/1954 Melikian et al.
2,811,340 A 10/1957 Aghnides
2,880,912 A 4/1959 Fisher
2,887,250 A 5/1959 Zilk
3,011,681 A 12/1961 Kromer
3,224,641 A 12/1965 Morgan
3,323,681 A 6/1967 Vette et al.
3,349,968 A 10/1967 Yuza
3,556,347 A 1/1971 Segal et al.
3,590,855 A 7/1971 Woollen et al.
3,777,937 A 12/1973 Buck
3,814,285 A 6/1974 Craig
3,853,244 A 12/1974 Neumann
3,991,911 A 11/1976 Shannon et al.
4,004,715 A 1/1977 Williams et al.
4,011,967 A 3/1977 Halsey et al.
4,162,028 A 7/1979 Reichenberger
4,202,387 A 5/1980 Upton
RE30,301 E 6/1980 Zygiel
4,211,342 A 7/1980 Jamgochian et al.
4,218,014 A 8/1980 Tracy
4,265,371 A 5/1981 Desai et al.
4,282,987 A 8/1981 Thomas et al.
4,392,588 A 7/1983 Scalera
4,433,795 A 2/1984 Maiefski et al.
4,437,499 A 3/1984 Devale
4,467,222 A 8/1984 Gross et al.
4,509,690 A 4/1985 Austin et al.
4,517,651 A 5/1985 Kawasaki et al.
4,529,009 A 7/1985 Homer et al.
4,694,228 A 9/1987 Michaelis
4,736,875 A 4/1988 King
4,753,370 A 6/1988 Rudick
4,784,297 A 11/1988 Katz
4,808,346 A 2/1989 Strenger
4,830,862 A 5/1989 Braun et al.
4,835,701 A 5/1989 Ohiwa et al.
4,863,068 A 9/1989 Smith
4,881,663 A 11/1989 Seymour
4,923,092 A 5/1990 Kirschner et al.
4,940,164 A 7/1990 Hancock et al.
4,946,701 A 8/1990 Tsai et al.
4,962,866 A 10/1990 Phillips
4,979,639 A 12/1990 Hoover et al.
4,987,083 A 1/1991 Apple et al.
4,992,282 A 2/1991 Mehansho et al.
5,009,082 A 4/1991 Abraham, III
5,011,700 A 4/1991 Gustafson et al.
5,021,219 A 6/1991 Rudick et al.
5,027,284 A 6/1991 Senghaas et al.
5,033,651 A 7/1991 Whigham et al.
5,082,143 A 1/1992 Schramm, Jr.
5,108,774 A 4/1992 Mills et al.
5,129,548 A 7/1992 Wisniewski
5,190,188 A 3/1993 Credle
5,203,474 A 4/1993 Haynes
5,219,224 A 6/1993 Pratt
5,269,442 A 12/1993 Vogel
5,314,091 A 5/1994 Credle, Jr.
5,349,989 A 9/1994 Legallais
5,353,958 A 10/1994 Hawkins
5,368,205 A 11/1994 Groh
5,388,725 A 2/1995 Lichfield
5,454,406 A 10/1995 Rejret et al.
5,473,909 A 12/1995 Kateman et al.
5,474,791 A 12/1995 Zablocki et al.
5,549,219 A 8/1996 Lancaster
5,592,867 A 1/1997 Walsh et al.
5,642,761 A 7/1997 Holbrook
5,660,867 A 8/1997 Reynolds et al.
5,706,661 A 1/1998 Frank
5,725,125 A 3/1998 Bessette et al.
5,731,981 A 3/1998 Simard
5,788,449 A 8/1998 Riemersma
5,803,320 A 9/1998 Cutting et al.
5,853,244 A 12/1998 Hoff et al.
5,870,944 A 2/1999 Vander Zalm et al.
5,930,146 A 7/1999 Takenaka
5,950,870 A 9/1999 Takenaka
5,976,602 A 11/1999 Baron et al.
5,980,969 A 11/1999 Mordini et al.
5,997,924 A 12/1999 Olander, Jr. et al.
6,004,610 A 12/1999 Wang et al.
6,039,987 A 3/2000 Strahl
6,047,859 A 4/2000 Schroeder et al.
6,060,092 A 5/2000 Oesterwind et al.
6,098,842 A 8/2000 Schroeder et al.
6,139,895 A 10/2000 Zablocki et al.
6,173,862 B1 1/2001 Buca et al.
6,186,193 B1 2/2001 Phallen et al.
6,202,894 B1 3/2001 Struminski et al.
6,234,354 B1 5/2001 Phillips et al.
6,237,810 B1 5/2001 Credle, Jr.
6,253,963 B1 7/2001 Tachibana
6,265,012 B1 7/2001 Shamil
6,321,938 B1 11/2001 Edwards et al.
6,345,729 B1 2/2002 Santy, Jr.
6,374,845 B1 4/2002 Melendez et al.
6,382,470 B1 5/2002 Hu et al.
6,401,598 B1 6/2002 Tavlarides
6,419,120 B1 7/2002 Bertone
6,449,532 B1 9/2002 Nicol
6,478,192 B2 11/2002 Heyes
6,505,758 B2 1/2003 Black et al.
6,547,100 B2 4/2003 Phillips et al.
6,599,546 B2 7/2003 Palaniappan
6,634,783 B2 10/2003 Baron
6,637,929 B2 10/2003 Baron
6,640,650 B2 11/2003 Matsuzawa et al.
6,681,031 B2 1/2004 Cohen et al.
6,685,059 B2 2/2004 Jones et al.
6,698,229 B2 3/2004 Renken et al.
6,723,365 B2 4/2004 Balaban
6,723,369 B2 4/2004 Burgess
6,726,947 B1 4/2004 Gutwein et al.
6,742,552 B2 6/2004 Raniwala
6,756,069 B2 6/2004 Scoville et al.
6,761,036 B2 7/2004 Teague et al.
6,766,656 B1 7/2004 Crisp et al.
6,814,990 B2 11/2004 Zeng
6,827,529 B1 12/2004 Berge et al.
6,866,877 B2 3/2005 Clark et al.
6,871,761 B2 3/2005 Fox
6,877,635 B2 4/2005 Stratton
6,901,968 B2 6/2005 Thomson
6,907,741 B2 6/2005 Kateman
6,952,928 B2 10/2005 Kateman et al.

(56) References Cited

U.S. PATENT DOCUMENTS 6,981,387 B1 1/2006 Morgan
6,983,863 B2 1/2006 Santy, Jr.
6,994,231 B2 2/2006 Jones
7,032,780 B2 4/2006 Crisp, III
7,044,336 B2 5/2006 Bertone
7,070,068 B2 7/2006 Fox
7,077,290 B2 7/2006 Bethuy et al.
7,108,156 B2 9/2006 Fox
7,159,743 B2 1/2007 Brandt et al.
7,195,394 B2 3/2007 Singh
7,201,005 B2 4/2007 Voglewede et al.
7,265,673 B2 9/2007 Teller
7,295,889 B2 11/2007 Lahteenmaki
7,334,706 B2 2/2008 Schroeder et al.
7,337,920 B2 3/2008 Duck et al.
7,356,381 B2 4/2008 Crisp, III
7,383,966 B2 6/2008 Ziesel
7,445,133 B2 11/2008 Ludovissie et al.
7,487,887 B2 2/2009 Ziesel
7,507,430 B2 3/2009 Stearns et al.
7,571,835 B2 8/2009 Hill et al.
7,577,496 B2 * 8/2009 Walker ..... G06Q 20/10 235/381
7,578,415 B2 8/2009 Ziesel et al.
7,631,788 B2 12/2009 Litterst et al.
7,648,050 B1 1/2010 Ehlers
7,661,352 B2 2/2010 Sher et al.
7,665,632 B2 2/2010 Ziesel
7,698,021 B2 4/2010 Hughes et al.
7,726,136 B2 6/2010 Baxter et al.
7,757,896 B2 7/2010 Carpenter et al.
7,762,181 B2 7/2010 Boland et al.
7,789,273 B2 9/2010 Kadyk et al.
7,798,367 B2 9/2010 Minard et al.
7,799,363 B2 9/2010 Sherwood et al.
D625,952 S 10/2010 Nevarez et al.
7,806,294 B2 10/2010 Gatipon et al.
7,837,071 B2 11/2010 Achrainer
7,866,509 B2 1/2011 Ziesel
7,905,373 B2 3/2011 Beavis et al.
7,913,879 B2 3/2011 Carpenter et al.
7,997,448 B1 8/2011 Leyva
8,047,402 B2 11/2011 Ziesel
8,074,835 B2 12/2011 MacMichael et al.
8,083,100 B2 12/2011 Minard et al.
8,091,736 B2 1/2012 Beavis et al.
8,091,737 B2 1/2012 Smeller et al.
8,181,824 B2 5/2012 Ziesel et al.
8,985,396 B2 3/2015 Jersey et al.
2001/0017815 A1 8/2001 Ackermann et al.
2002/0056721 A1 5/2002 Phillips et al.
2002/0102331 A1 8/2002 Chang et al.
2002/0122866 A1 9/2002 Palaniappan et al.
2003/0080443 A1 5/2003 Bosko
2003/0088465 A1 * 5/2003 Monteverde ..... G06Q 30/02 705/14.16
2003/0101735 A1 6/2003 Teague et al.
2003/0173370 A1 9/2003 Park
2003/0230597 A1 12/2003 Naik
2004/0007594 A1 1/2004 Esch et al.
2004/0026451 A1 2/2004 Jones
2004/0040983 A1 3/2004 Ziesel
2004/0129724 A1 7/2004 Stratton
2004/0162633 A1 * 8/2004 Kraft ..... G07F 11/72 700/234
2004/0182250 A1 9/2004 Halliday et al.
2005/0029295 A1 2/2005 Fox
2005/0035152 A1 2/2005 Bethuy et al.
2005/0072799 A1 4/2005 Stratton
2005/0106305 A1 5/2005 Abraham et al.
2005/0166761 A1 8/2005 Jones et al.
2005/0166766 A1 8/2005 Jones et al.
2005/0178793 A1 8/2005 Cheng et al.
2005/0199127 A1 9/2005 Wimmer et al.
2005/0230421 A1 10/2005 Morrow et al.
2005/0251287 A1 11/2005 Thornton et al.
2005/0284885 A1 12/2005 Kadyk et al.
2006/0081653 A1 4/2006 Boland et al.
2006/0097009 A1 5/2006 Bethuy et al.
2006/0113323 A1 6/2006 Jones
2006/0115570 A1 6/2006 Guerrero et al.
2006/0115572 A1 6/2006 Guerrero et al.
2006/0123994 A1 6/2006 Greiwe et al.
2006/0157504 A1 7/2006 Barker et al.
2006/0172056 A1 8/2006 Tobin et al.
2006/0191964 A1 8/2006 Ziesel
2006/0196886 A1 9/2006 Fox
2006/0237479 A1 10/2006 Fox
2006/0278093 A1 12/2006 Biderman et al.
2006/0286262 A1 12/2006 Stearns et al.
2006/0289563 A1 12/2006 Ziesel
2007/0054026 A1 3/2007 Grenville et al.
2007/0131711 A1 6/2007 Minard et al.
2007/0131715 A1 6/2007 Minard et al.
2007/0157656 A1 7/2007 Hall
2007/0205219 A1 9/2007 Ziesel et al.
2007/0205220 A1 9/2007 Rudick et al.
2007/0205221 A1 9/2007 Carpenter et al.
2007/0212468 A1 9/2007 White et al.
2007/0218181 A1 9/2007 Illsley et al.
2007/0267441 A1 11/2007 van Opstal et al.
2008/0020115 A1 1/2008 Guerrero et al.
2008/0023099 A1 1/2008 Schubert et al.
2008/0029541 A1 2/2008 Wallace et al.
2008/0041876 A1 2/2008 Frank et al.
2008/0054837 A1 3/2008 Beavis et al.
2008/0073376 A1 3/2008 Gist et al.
2008/0081088 A1 4/2008 Lederman et al.
2008/0144427 A1 6/2008 Phallen
2008/0175970 A1 7/2008 Kobayashi et al.
2008/0206415 A1 8/2008 Sherwood et al.
2008/0206429 A1 8/2008 Guerrero et al.
2008/0226770 A1 9/2008 Lee et al.
2008/0226773 A1 9/2008 Lee
2008/0226797 A1 9/2008 Lee et al.
2008/0226798 A1 9/2008 Talebi et al.
2008/0271809 A1 11/2008 Goldman et al.
2008/0277420 A1 11/2008 Edwards et al.
2008/0300714 A1 12/2008 Hughes et al.
2008/0314452 A1 12/2008 Smith
2008/0314926 A1 12/2008 Kumar et al.
2009/0032609 A1 2/2009 Ziesel
2009/0065570 A1 * 3/2009 Peters ..... B67D 1/0041 235/378
2009/0069932 A1 3/2009 Rudick
2009/0069933 A1 3/2009 Rudick et al.
2009/0069934 A1 3/2009 Newman et al.
2009/0069949 A1 3/2009 Carpenter et al.
2009/0117224 A1 5/2009 Robergs
2009/0120958 A1 5/2009 Landers et al.
2009/0125457 A1 5/2009 Farhan et al.
2009/0159612 A1 6/2009 Beavis et al.
2009/0162488 A1 6/2009 Bell et al.
2009/0194560 A1 8/2009 Freeman et al.
2009/0222340 A1 * 9/2009 Insolia ..... G06Q 20/10 705/14.31
2009/0230149 A1 9/2009 Smeller et al.
2009/0235826 A1 9/2009 Hart et al.
2009/0250491 A1 10/2009 Erman et al.
2009/0277516 A1 11/2009 Winkler et al.
2009/0285966 A1 11/2009 Tso et al.
2009/0315740 A1 12/2009 Hildreth et al.
2010/0005903 A1 1/2010 Beavis
2010/0006592 A1 1/2010 Maas et al.
2010/0030355 A1 * 2/2010 Insolia ..... G06Q 30/0601 700/97
2010/0065587 A1 3/2010 Erman et al.
2010/0089948 A1 4/2010 Ziesel et al.
2010/0116842 A1 5/2010 Hecht et al.
2010/0133293 A1 6/2010 Ziesel
2010/0143581 A1 6/2010 Eldershaw et al.
2010/0147875 A1 6/2010 Santos et al.
2010/0163572 A1 7/2010 Downham
2010/0170918 A1 7/2010 Achrainer

(56) References Cited

U.S. PATENT DOCUMENTS

| | | | | |
|---|---|---|---|---|
| 2010/0200110 | A1 | 8/2010 | Segiet et al. | |
| 2010/0206902 | A1 | 8/2010 | Engels et al. | |
| 2010/0217685 | A1 | 8/2010 | Melcher et al. | |
| 2010/0237099 | A1 | 9/2010 | Carpenter et al. | |
| 2010/0260914 | A1 | 10/2010 | Seta et al. | |
| 2010/0275267 | A1* | 10/2010 | Walker | G07F 9/023 726/26 |
| 2010/0318225 | A1* | 12/2010 | Claesson | B67D 1/0021 700/265 |
| 2011/0011490 | A1 | 1/2011 | Rodrigues | |
| 2011/0011888 | A2 | 1/2011 | Beavis et al. | |
| 2011/0045152 | A1 | 2/2011 | Stutz et al. | |
| 2011/0045161 | A1 | 2/2011 | Ziesel | |
| 2011/0049180 | A1 | 3/2011 | Carpenter et al. | |
| 2011/0068121 | A1 | 3/2011 | Frei et al. | |
| 2011/0069578 | A1 | 3/2011 | Sirbu Villa | |
| 2011/0073212 | A1 | 3/2011 | Erbs et al. | |
| 2011/0123688 | A1 | 5/2011 | Deo et al. | |
| 2011/0132923 | A1 | 6/2011 | Miller | |
| 2011/0146497 | A1 | 6/2011 | Sirbu Villa | |
| 2011/0163126 | A1 | 7/2011 | Carpenter et al. | |
| 2011/0204088 | A1 | 8/2011 | Luchinger | |
| 2011/0264285 | A1* | 10/2011 | Mattos, Jr. | B67D 1/0888 700/283 |

FOREIGN PATENT DOCUMENTS

| | | | |
|---|---|---|---|
| CA | 2662872 | A1 | 3/2008 |
| CA | 2667383 | A1 | 5/2008 |
| CN | 1283163 | A | 2/2001 |
| CN | 1708433 | A | 12/2005 |
| CN | 101300190 | A | 11/2008 |
| DE | 3434174 | A1 | 3/1986 |
| DE | 4237933 | A1 | 5/1994 |
| DE | 19526215 | A1 | 2/1996 |
| DE | 20 2006 010613 | U1 | 8/2007 |
| EP | 0426819 | A1 | 5/1991 |
| EP | 0958234 | A1 | 11/1999 |
| EP | 1 627 849 | A1 | 2/2006 |
| EP | 1626375 | A1 | 2/2006 |
| EP | 2 314 186 | A1 | 4/2011 |
| GB | 2091449 | A | 7/1982 |
| GB | 2101088 | A | 1/1983 |
| GB | 2130399 | A | 5/1984 |
| GB | 2166833 | A | 5/1986 |
| GB | 2 303 354 | A | 2/1997 |
| GB | 2416757 | A | 2/2006 |
| GB | 2429694 | A | 3/2007 |
| JP | H02-004699 | | 1/1990 |
| JP | H06-508089 | | 9/1994 |
| JP | 2000-238896 | | 9/2000 |
| JP | 2002-308390 | | 10/2002 |
| JP | 2006-243964 | | 9/2006 |
| JP | 2006-243964 | A | 9/2006 |
| JP | 2009-528919 | | 8/2009 |
| JP | 2016-019744 | | 2/2016 |
| WO | 9902449 | A1 | 1/1999 |
| WO | 2005111955 | A1 | 11/2005 |
| WO | 2007/056407 | A2 | 5/2007 |
| WO | 2008028294 | A1 | 3/2008 |
| WO | 2008049222 | A1 | 5/2008 |

* cited by examiner

MODULAR DISPENSING SYSTEM

CROSS-REFERENCE TO RELATED APPLICATION

This application is a continuation of U.S. application Ser. No. 13/116,247 filed on May 26, 2011, entitled "Modular Dispensing System," which is incorporated herein by reference in its entirety.

FIELD OF THE INVENTION

This disclosure relates generally to a method and modular beverage dispensing system for the dispensing of beverages, e.g., for restaurants (including fast food restaurants), theatres, convenience stores, gas stations, and other entertainment and/or food service venues.

BACKGROUND

Various beverage dispensers, such as those at restaurants, theatres and other entertainment and/or food service venues, typically have either a "drop in" dispenser apparatus or a counter top type dispenser apparatus. In a drop in dispenser apparatus, the dispenser apparatus is self-contained and may be dropped into an aperture of a counter top. In a counter top type dispenser apparatus, the dispenser apparatus is placed on a counter top. In conventional beverage dispensers, a dispensing head is coupled to a particular drink syrup supply source via a single pipe dedicated to supply the particular drink syrup to that dispensing head, wherein the particular drink syrup supply source is typically located near the counter top, i.e., directly under the counter top, or directly over the counter top.

A user will typically place a cup under the signage of the selected beverage and either press a button or press the cup against a dispensing lever to activate the dispenser so that the selected beverage is delivered from the dispensing head corresponding to the selected beverage and into the cup until pressure is withdrawn from the button or lever.

Conventional beverage dispensers are typically limited to dispensing drinks having flavoring supply sources located at their respective counters. Thus, a limited number of drinks are typically available at a conventional beverage dispenser. For example, drinks typically available at a conventional beverage dispenser are a regular cola beverage, a diet cola beverage, perhaps one or several non-cola carbonated beverages, such as a lemon-lime flavored carbonated beverage or some other fruit-flavored drink (e.g., orange flavored carbonated beverage, and/or root beer), and perhaps one more non-carbonated beverage(s), such as a tea and/or a lemonade.

Conventional dispensers are not typically configured to permit a user generate or receive from a single dispensing head a custom-ordered beverage that a consumer may wish to purchase, e.g., a cola flavored with cherry, vanilla, lemon, or lime, etc., or a tea flavored with lemon, orange, peach, raspberry, etc., or a tea having one or more teaspoons of sweetener (sugar, or some other nutritive sweetener or non-nutritive sweetener).

Conventional dispensers typically require servicing and resupply of flavoring sources at the counter.

Conventional dispensers typically require a dedicated dispensing head for each particular beverage.

What is needed is a beverage dispensing system that does not have the limitations and disadvantages of conventional beverage dispensers and methods.

SUMMARY

Accordingly, there is provided a modular dispensing system comprising at least one dispensing head at a counter, and a transfer unit located remotely from the counter, and piping extending from the transfer unit to the counter.

In one aspect, the transfer unit may comprise comprises a centralized flavor ingredient system having a plurality of beverage flavor ingredient sources, and the piping comprises a main micro bundle.

In one aspect, the main micro bundle comprises a plurality of separate lines with each line corresponding to a particular flavor ingredient source of the centralized ingredient system.

In one aspect, the at least one dispensing head has a corresponding doser unit. The doser unit may be configured to dose an appropriate amount of each flavor ingredient to the dispensing head.

In one aspect, the doser unit supplies an appropriate amount of each flavor ingredient to a dispensing head through a tower micro bundle, the tower micro bundle comprising a plurality of separate lines with each line corresponding to a particular flavor ingredient.

In one aspect, a modular dispensing system comprises at least one dispensing head at a counter, a transfer unit located remotely from the counter, piping extending from the transfer unit to the counter, the transfer unit comprising a central reconstitution factory system, the central reconstitution factory system comprising at least one mixing chamber corresponding to a predetermined beverage, the central reconstitution factory configured to combine water with at least one highly concentrated beverage ingredient in the mixing chamber to form a reconstituted mixture.

In one aspect, a modular dispensing system is provided comprising at least a first dispensing head and a second dispensing head at a counter, a transfer unit located remotely from the counter, and piping extending from the transfer unit to the counter. The transfer unit may comprise a central reconstitution factory system, the central reconstitution factory system comprising at least a first mixing chamber corresponding to a first predetermined beverage, and at least a second mixing chamber corresponding to a second predetermined beverage. The central reconstitution factory may be configured to combine water with at least a first highly concentrated beverage ingredient in the first mixing chamber to form a first reconstituted mixture, the central reconstitution factory further configured to combine water with at least a second highly concentrated beverage ingredient in the second mixing chamber to form a second reconstituted mixture.

The above and other aspects, features and advantages of the present disclosure will be apparent from the following detailed description of the illustrated embodiments thereof which are to be read in connection with the accompanying drawings.

DETAILED DESCRIPTION OF THE PREFERRED EMBODIMENTS

The embodiments discussed below may be used to form a wide variety of beverages, including but not limited to cold and hot beverages, and including but not limited to beverages known under any PepsiCo branded name, such as Pepsi-Cola®.

Figure 1:
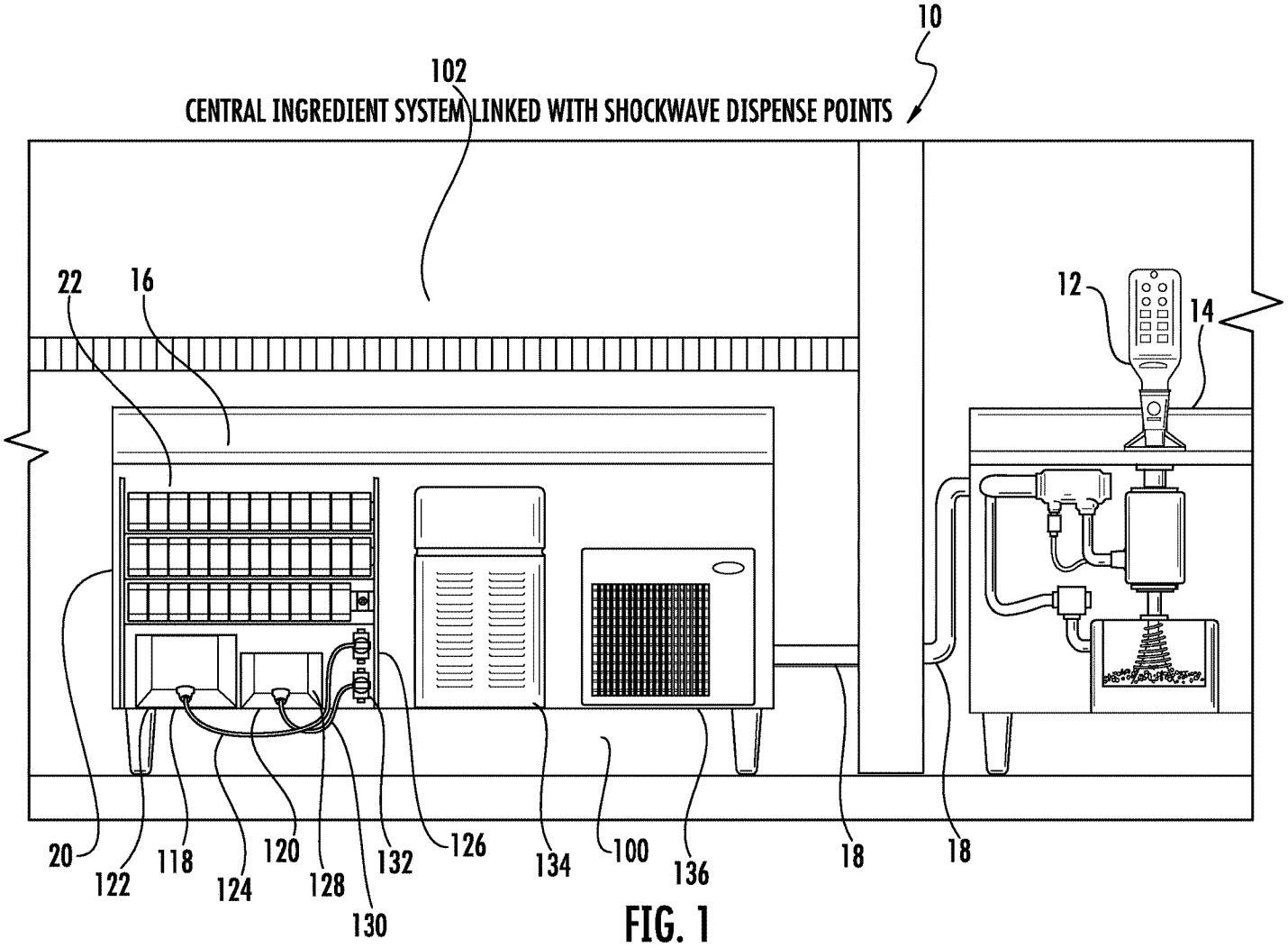
FIG. 1 is schematic view of an embodiment of a modular dispensing system according to various aspects of the disclosure.

Referring to FIG. 1, the description of one embodiment of the modular dispensing system of the present disclosure will be described.

Referring to FIG. 1, a modular dispensing system 10 may be provided comprising a plurality of dispensing heads 12 at a counter location 14, and a transfer unit 16 located remotely from the counter location 14. Piping 18 may extend from the transfer unit 16 to the counter location 14.

Figure 2:
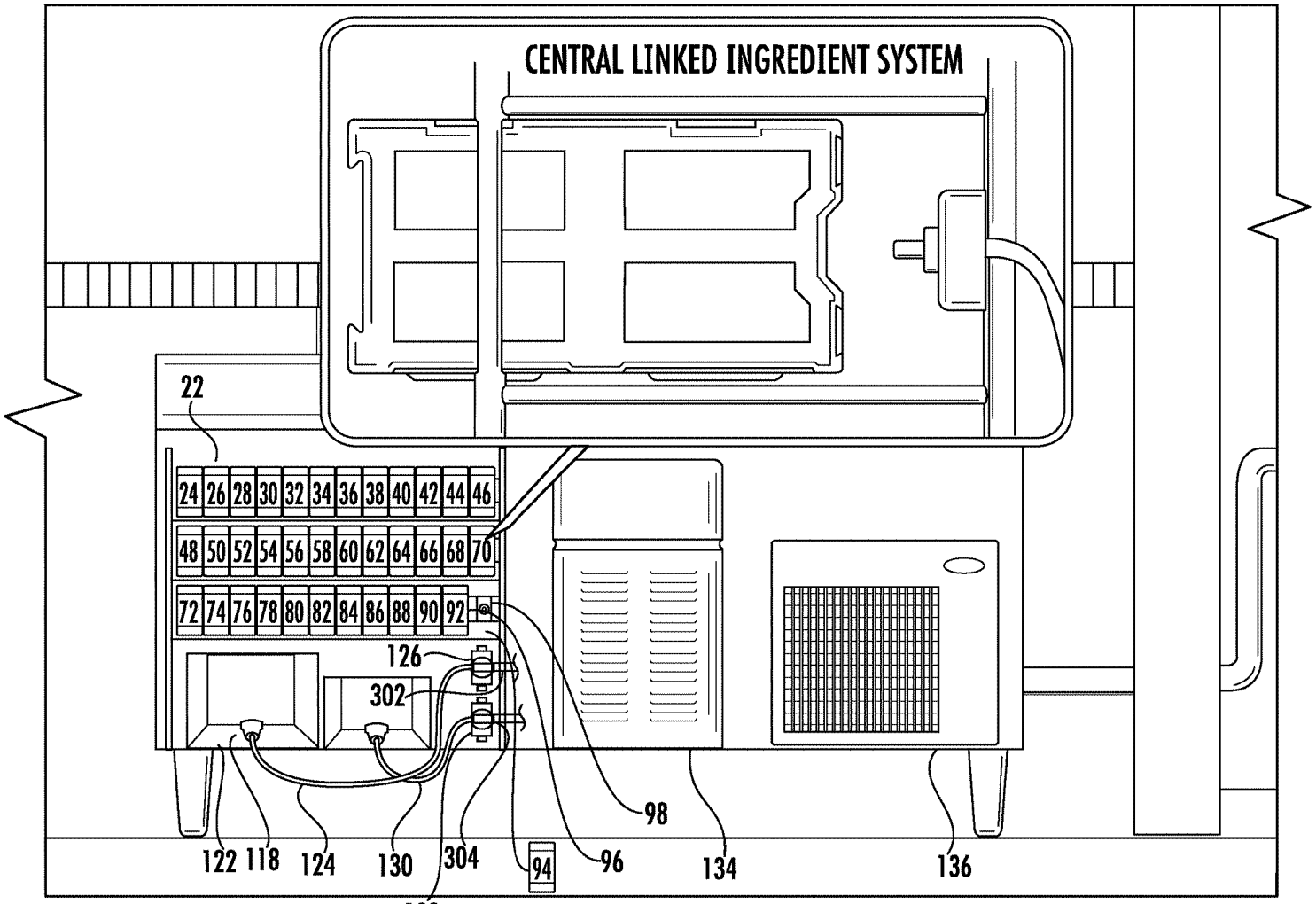
FIG. 2 illustrates an embodiment of a central linked ingredient system according to various aspects of the disclosure.
Figure 9:
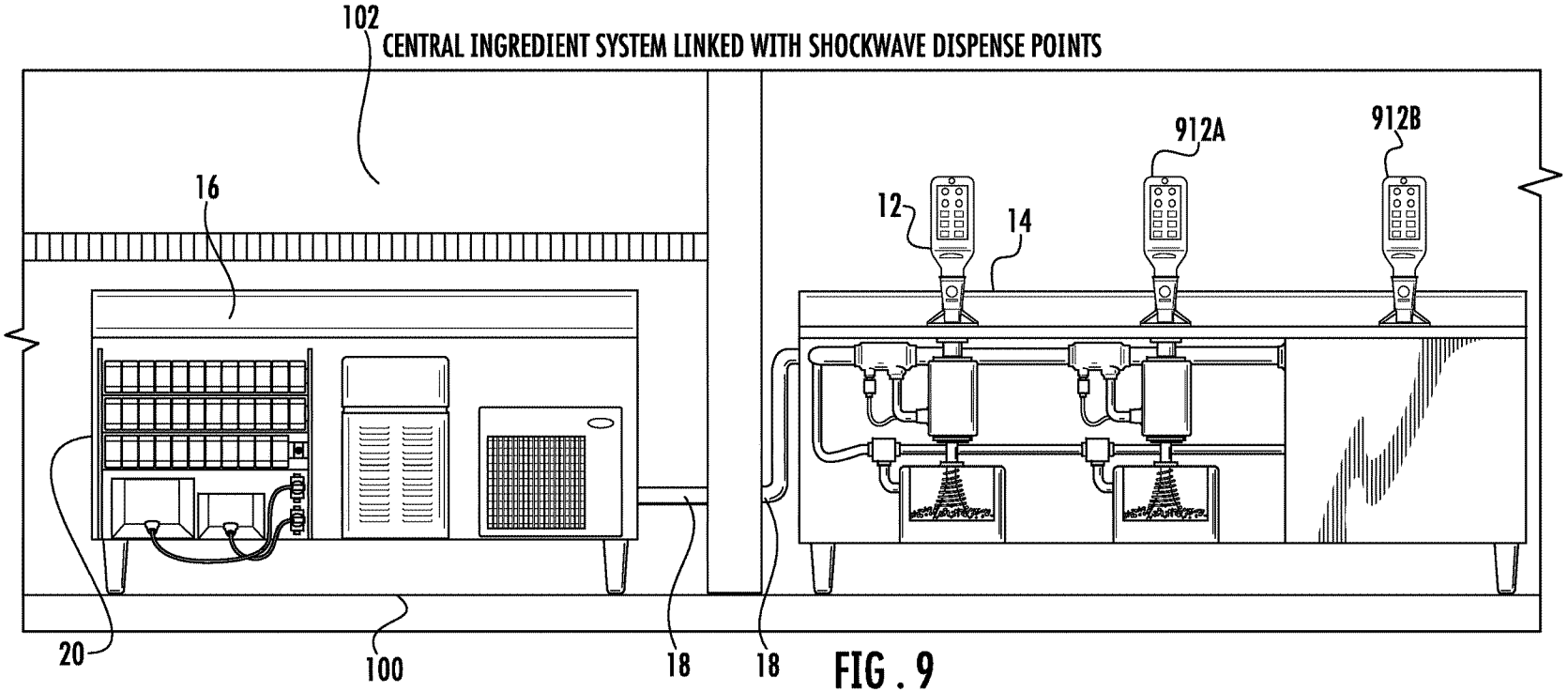
FIG. 9 illustrates the embodiment of FIG. 1, with the addition of additional dispensing heads at a single counter according to various aspects of the disclosure.
Figure 10:
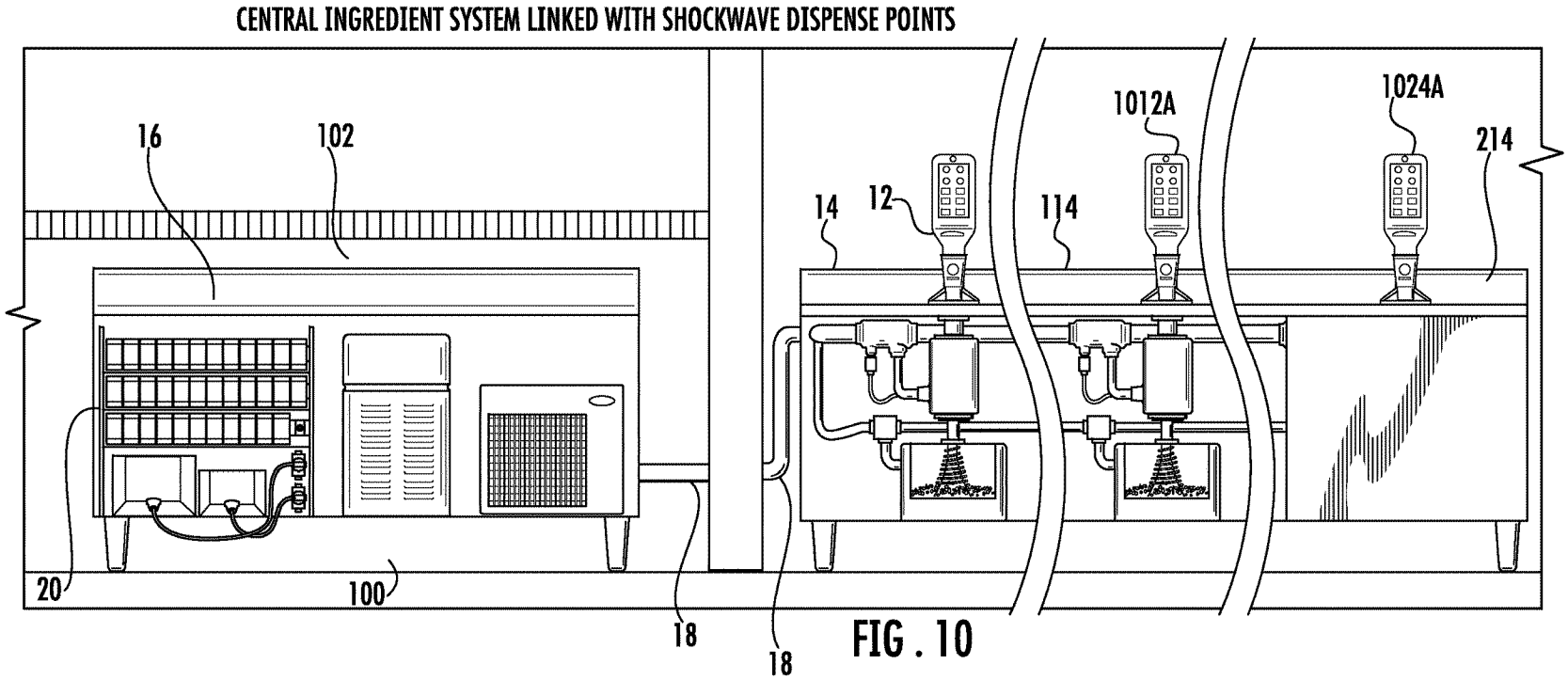
FIG. 10 illustrates the embodiment of FIG. 1, with the addition of an additional counter having an additional dispensing head according to various aspects of the disclosure.
Figure 11:
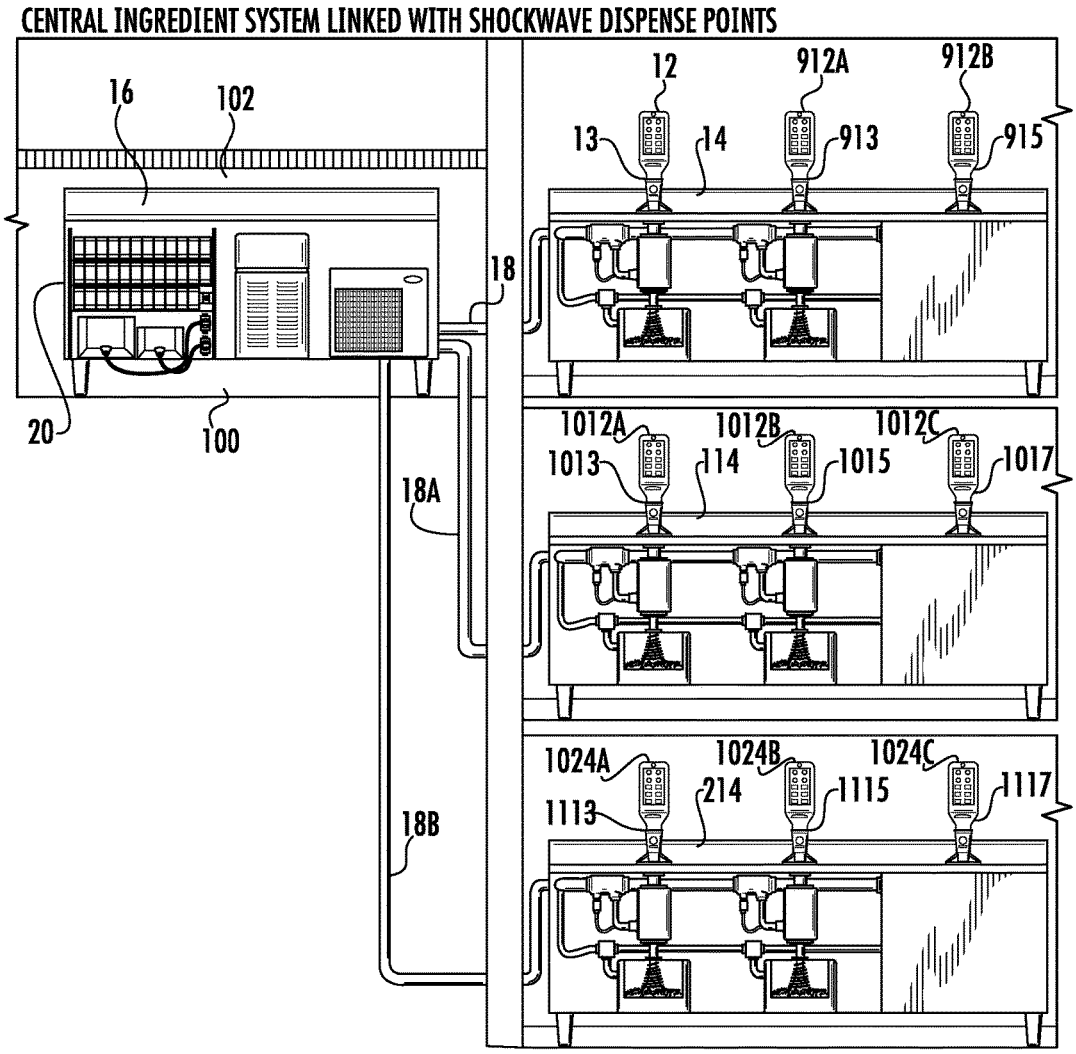
FIG. 11 illustrates the embodiment of FIG. 10, with the addition of additional dispensing heads at each counter according to various aspects of the disclosure.

Referring to FIG. 1 and FIG. 2, the transfer unit 16 may comprise a centralized ingredient system 20 having a plurality of sources 22 of beverage ingredients 24, 26, 28, 30, 32, 34, 36, 38, 40, 42, 44, 46, 48, 50, 52, 54, 56, 58, 60, 62, 64, 66, 68, 70, 72, 74, 76, 78, 80, 82, 84, 86, 88, 90, 92, and 94. FIGS. 1 and 2 show that beverage ingredient 94 may be placed next to beverage ingredient 92, and beverage ingredient 94 may flow into an opening 96 of pipe 98. As described in greater detail below, pipe 98 may be one of the pipes that comprise piping 18. The centralized ingredient system 20 may supply beverage ingredients 24 through 94 to a dispensing head 12 for more than one beverage. FIG. 9 illustrates the embodiment of FIG. 1, with the addition of additional dispensing heads 912A and 912B at a single counter 14. FIG. 10 illustrates the embodiment of FIG. 1, with the addition of an additional counter 114 having an additional dispensing head 1012A, and an additional counter 214 having an additional dispensing head 1024A. At least one of the dispensing heads may be a dispensing head for a drive-through pick up window. While the counters in FIG. 10 depicts the counters in series, those of skill in the art will recognize that the counters may also be configured in parallel, e.g., with a separate micro bundle leaving transfer unit 16 for each counter. FIG. 11 illustrates a variation of embodiments shown in FIG. 9 and FIG. 10, showing dispensing heads 12, 912A, and 912B at counter 14 (which may be supplied with beverage ingredients via main micro bundle 18), dispensing heads 1012A, 1012B and 1012C at counter 114 (which may be supplied with beverage ingredients via main micro bundle 18A), and dispensing heads 1024A, 1024B and 1024 at counter 214 (which may be supplied with beverage ingredients via main micro bundle 18B). While the counters in FIG. 11 depicts the counters in parallel, those of skill in the art will recognize that the counters may also be configured in series, e.g., with a single main micro bundle 18 leaving transfer unit 16 and supplying beverage ingredients to each counter 14, 114, and 124 in series. At least one counter may have a dispensing head dedicated supplying beverages for a drive through window. Those of skill in the art will recognize that the system may have the same or different beverage ingredients supplied to different dispensing heads located at different dispensing towers 13, 913, 915, 1013, 1015, 1017, 1113, 1115 and 1117.

Centralized ingredient system 20 may supply beverage ingredients 24 through 94 for a greater number of beverages than the number of dispensing heads 12 that are located at one counter location 14. As shown in FIG. 10, the centralized ingredient system 20 may supply beverages to dispensing heads located at counter locations 14, 114, 214 that are remote from one another, including but not limited to a counter location 214 for a drive-through window. The centralized ingredient system 20 may be placed at a remote location 100 from counter locations 14, 114, 214, e.g., a back room 102, which preferably is not viewable from at least one counter location. In a preferred embodiment, the centralized ingredient system is not viewable by patrons or customers using a dispenser and/or purchasing a beverage at a counter location.

Figure 3:
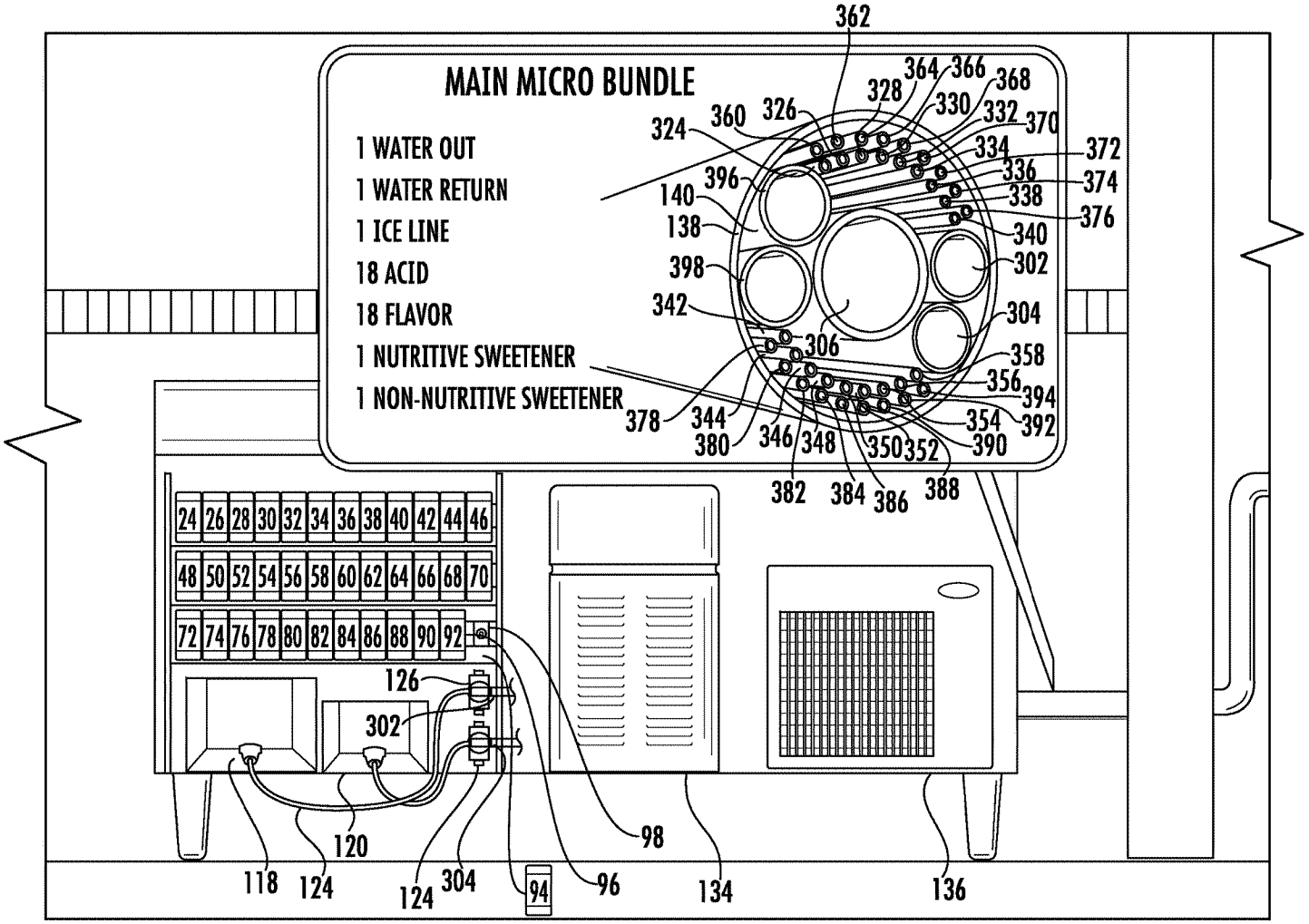
FIG. 3 illustrates is a perspective of an embodiment of a main micro bundle according to various aspects of the disclosure.
Figure 8A:
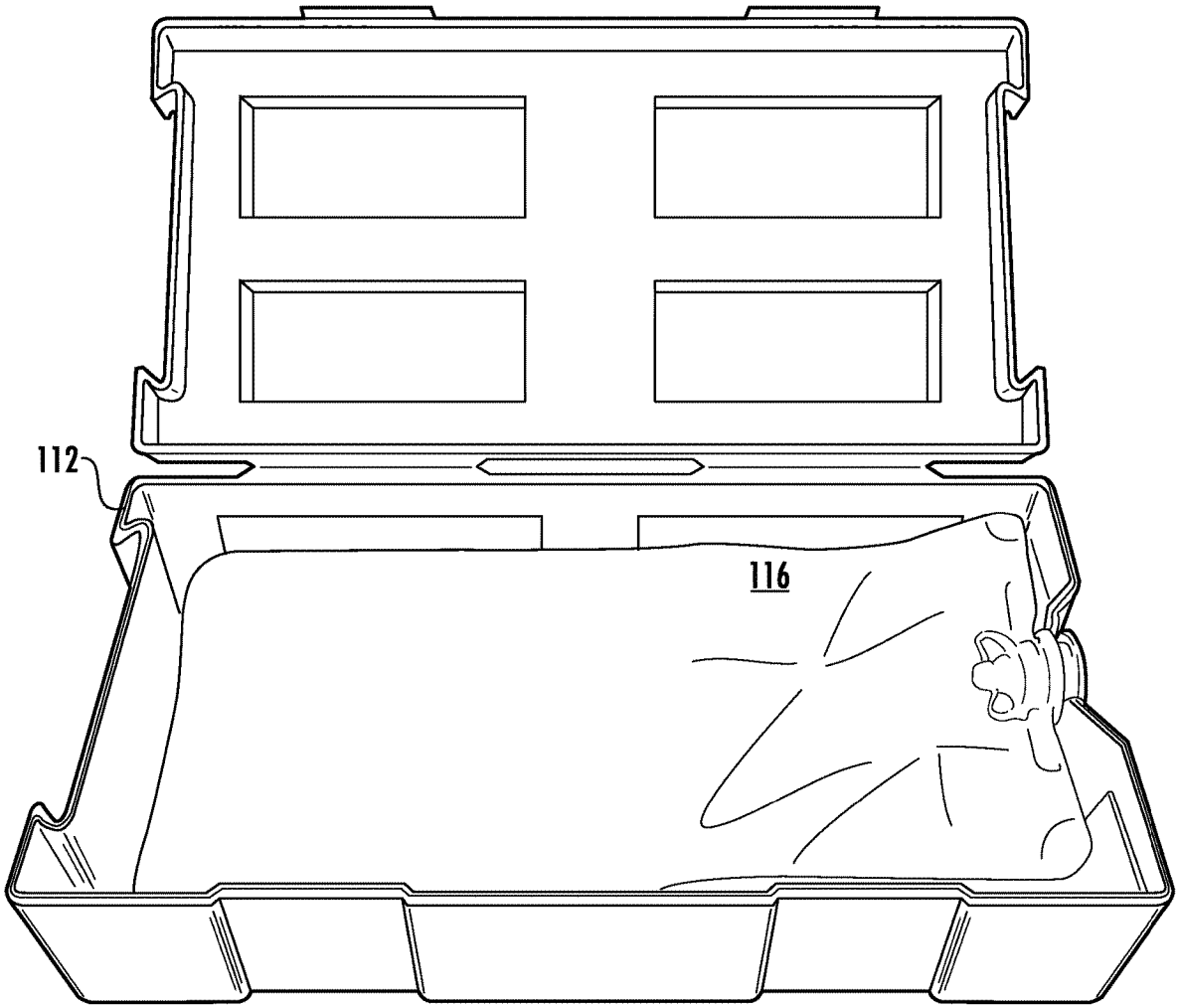
FIGS. 8A and 8B illustrate an embodiment of a cartridge for a beverage ingredient according to various aspects of the disclosure.
Figure 8B:
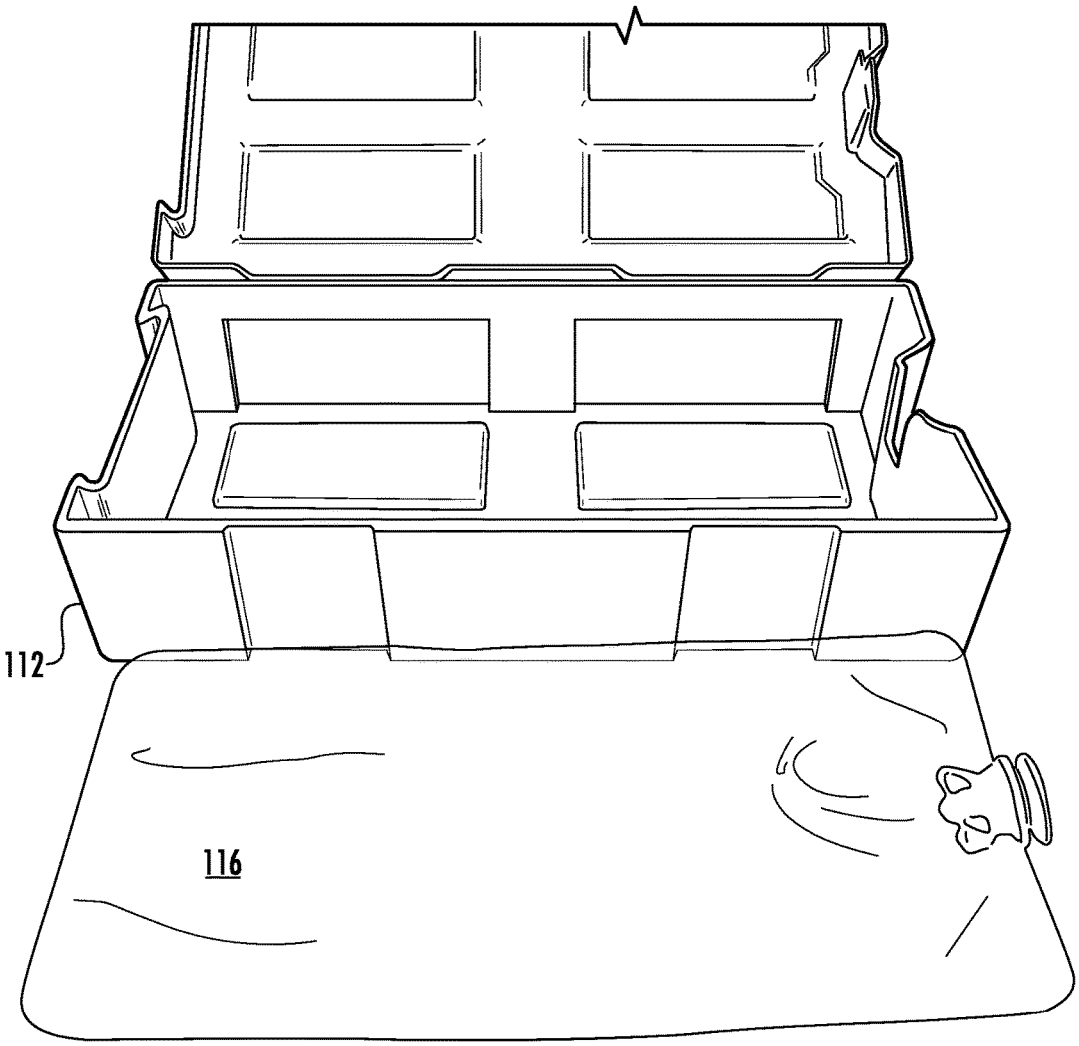

The centralized ingredient system 20 may comprise a plurality of highly concentrated ingredients for micro dosing in the preparation of a wide variety of beverages. For example, but not by way of limitation, FIGS. 1, 2, and 3 illustrate thirty-six beverage ingredients 24 through 94. Each beverage ingredient 24 through 94 may be stored in a cartridge or storage container 112. As shown in FIGS. 8A and 8B, cartridge 112 may comprise a bag 116 filled with a beverage ingredient. Each cartridge 112 may store an ingredient that is different from the ingredient stored in every other cartridge 112 that comprise a grouping of plurality of sources 22.

The centralized ingredient system 20 may comprise a plurality of sweeteners 118 and 120. Sweetener 118 may be a nutritive sweetener, and sweetener 120 may be a non-nutritive sweetener.

Transfer unit 16 comprises nutritive sweetener cartridge or container 122, which contains nutritive sweetener 118, and corresponding nutritive sweetener in pump line 124, nutritive sweetener pump 126, and nutritive sweetener out pump line 302.

Transfer unit 16 may comprise non-nutritive sweetener cartridge or container 128, which may contain non-nutritive sweetener 120, and corresponding non-nutritive sweetener in pump line 130, non-nutritive pump 132, and non-nutritive sweetener out pump line 304.

Pump 126 may pump nutritive sweetener 118, and pump 132 may pump non-nutritive sweetener 120 from the transfer unit 16 through piping 18 to dispensing head 12.

Other pumps (not shown) may be used to pump beverage ingredients 24 through 94 from the transfer unit 16 through piping 18 to dispensing head 12.

Another pump or pumps (not shown) may be used to pump water from transfer unit 16 through piping 18 to dispensing head 12. The transfer unit 16 may comprise a water treatment system 134. Water treatment system 134 may be used to treat water. For example, water treatment system 134 may be used to cool water to a desired temperature for a cold beverage. A second water treatment (not shown) may be used to heat water to desired temperature for hot beverages. Water temperature ranges provided by water treatment system(s) used in connection with water treatment systems may be just below about freezing (e.g., to create or prepare a slurry or slush product) through about 180 degrees Fahrenheit (e.g. to create or prepare a hot beverage, such as a coffee or tea). The water treatment system may be any suitable water treatment system that improves taste, reduces odors, and/or reduces chlorines. The water treatment system may be any suitable water treatment system that may improve water quality to near pure water through systems, including but not limited to reverse osmosis (RO). As discussed in greater detail below, treated water is from water treatment system, and a least one beverage ingredient from the centralized ingredient system may be provided to counter location 14. The ratio of water from water treatment system 134 to beverage ingredients provided from centralized ingredient system 20 for a beverage may be about 200 to 1 by weight. In one embodiment, the minimum ingredient may be about 200:1, or about 75:1, or about 40:1 (e.g., in the form of a flavor or acid), through about 40:1 for non-nutritive sweeteners, and about 6:1 for non-nutritive sweeteners. A base beverage may be prepared with about four streams, e.g., water, a sweetener, flavor, and acid. Additional streams may be added to provide top notes, e.g., cherry flavor, or sweetener blends to reduce calories, such as disclosed in U.S. Ser. No. 12/703,048, filed Feb. 9, 2010, which is incorporated herein by reference in its entirety.

Another pump or pumps (not shown) may be used to pump ice from transfer unit 16 through piping 18 to dispensing head 12. In one preferred embodiment, the transfer unit 16 may comprise an ice machine 136.

As shown in FIG. 3, piping or main micro bundle 18 comprises an outer pipe 138, and bundle of smaller inner pipes 140. Inner pipes 140 may comprise beverage ingredient flavor lines 324, 326, 328, 330, 332, 334, 336, 338, 340, 342, 344, 346, 348, 350, 352, 354, 356, and 358, Inner pipes 140 may comprise beverage ingredient acid lines 360, 362, 364, 366, 368, 370, 372, 374, 376, 378, 380, 382, 384, 386, 388, 390, 392, and 394.

Beverage ingredient flavor line 324 corresponds to beverage ingredient 24, beverage ingredient flavor line 326 corresponds to beverage ingredient 26, etc. The following Table I identifies the correspondence between beverage ingredients and lines.

TABLE I

| Beverage ingredient | Line |
|---|---|
| 24 | 324 |
| 26 | 326 |
| 28 | 328 |
| 30 | 330 |
| 32 | 332 |
| 34 | 334 |
| 36 | 336 |
| 38 | 338 |
| 40 | 340 |
| 42 | 342 |
| 44 | 344 |
| 46 | 346 |
| 48 | 348 |
| 50 | 350 |
| 52 | 352 |
| 54 | 354 |
| 56 | 356 |
| 58 | 358 |
| 60 | 360 |

TABLE I-continued

| Beverage ingredient | Line |
|---|---|
| 62 | 362 |
| 64 | 364 |
| 66 | 366 |
| 68 | 368 |
| 70 | 370 |
| 72 | 372 |
| 74 | 374 |
| 76 | 376 |
| 78 | 378 |
| 80 | 380 |
| 82 | 382 |
| 84 | 384 |
| 86 | 386 |
| 88 | 388 |
| 90 | 390 |
| 92 | 392 |
| 94 | 394 |

FIG. 3 illustrates a water out line 396, water return line 398, ice line 306, nutritive sweetener out pump line 302, and non-nutritive sweetener out pump line 304. Water return line 398 may allow for the circulating of water that is not dispensed from a dispensing head 12 to be returned to transfer unit 16 to makeup cold water to be supplied from transfer unit 16 to doser unit 400 (shown in FIG. 4). This helps conserve energy since the water in water return line 398 will be closer to the desired temperature than water that has not been previously cooled. A hot water out line and a hot water return line may also be provided. A hot water return line (not show) may be used to allow for the circulating of water that is not dispensed from a dispensing head 12 to be returned to transfer unit 16 to makeup hot water to be supplied from transfer unit to doser unit 64. This helps conserve energy since the water in a hot water return line be will closer to the desired temperature than water that has not been previously heated. The ice line 306 may be the largest of the lines in the bundle. Water out line 396 and water return line 398 may be about equal diameter, e.g., about ⅜" diameter lines. The nutritive sweetener out pump line 302 may have about equal diameter or slightly larger diameter as the non-nutritive sweetener out pump line 304. For example, the nutritive sweetener line may have a diameter of about ⅜" inches, and the non-nutritive sweetener may have a diameter of about ¼" inches. The sweetener lines may comprise any desired number, e.g. four different sweetener lines.

Figure 4:
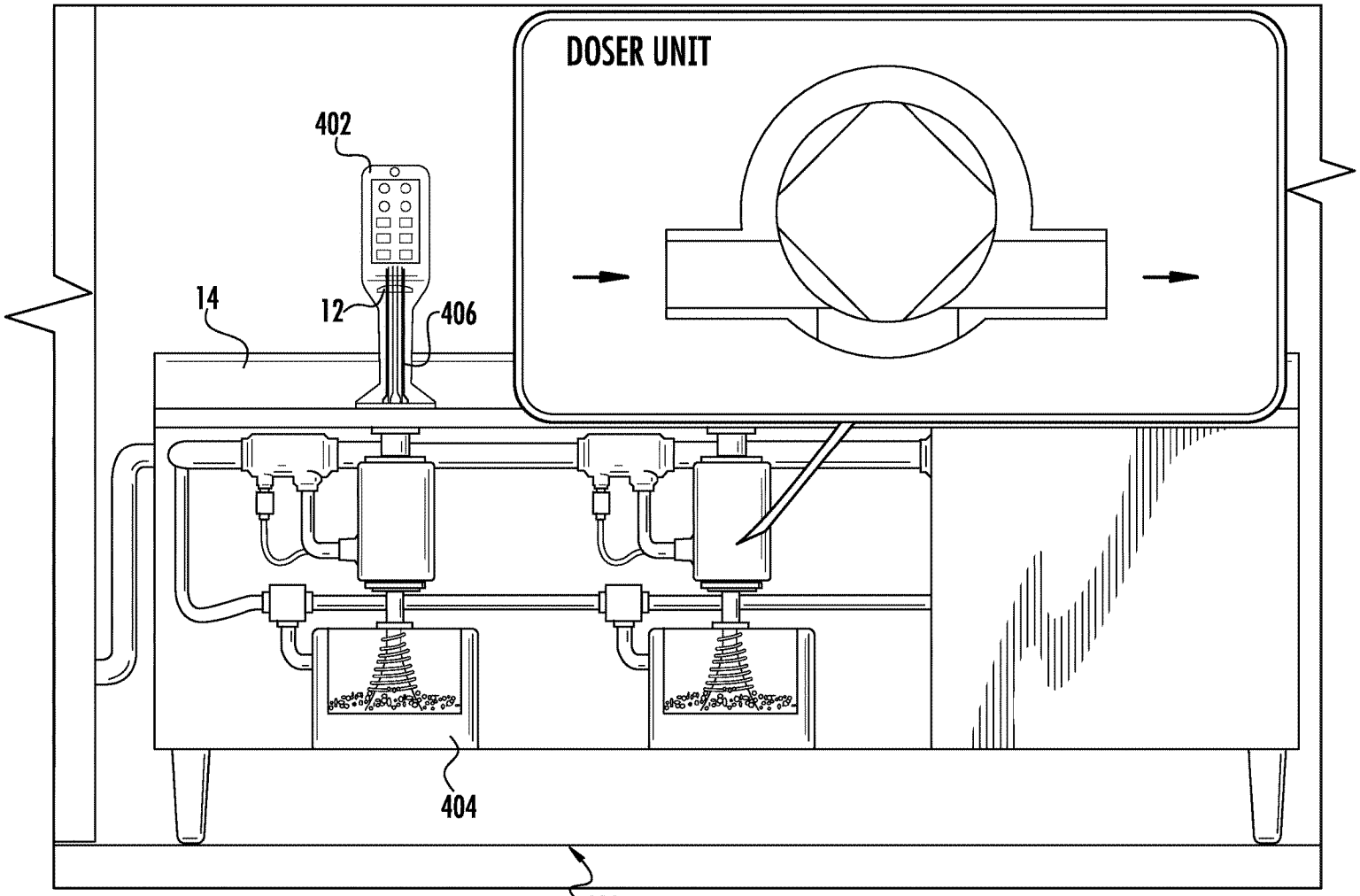
FIG. 4 illustrates an embodiment of a doser unit according to various aspects of the disclosure.

As shown in FIG. 4, doser unit 400 may comprise dispenser tower 402, which may comprise dispenser head 12 at counter location 14. Doser unit 400 may comprise an ice hopper 404. Doser unit 404 may receive liquid under pressure and dose appropriately to provide a desired beverage. The dosing of a beverage ingredient may be between about 0.1 cc up to about 0.1 cc to about 17 cc. In one embodiment, dosing may be about 0.5 cc to 17 cc for nutritive sweetener. Dosing may be performed by a sliding vane pump as shown in FIG. 4, or other suitable positive displacement pump, gear pump piston pump, oscillating pump, or diaphragm pump (not shown). The pump may be controlled through, pulse width modulation, stroked or stepped to deliver the appropriate volume of an ingredient to form a beverage. Those of skill in the art will recognize that control of delivery may be achieved through use of an intelligent device, such as a computer or purpose embedded electronics.

Figure 5:
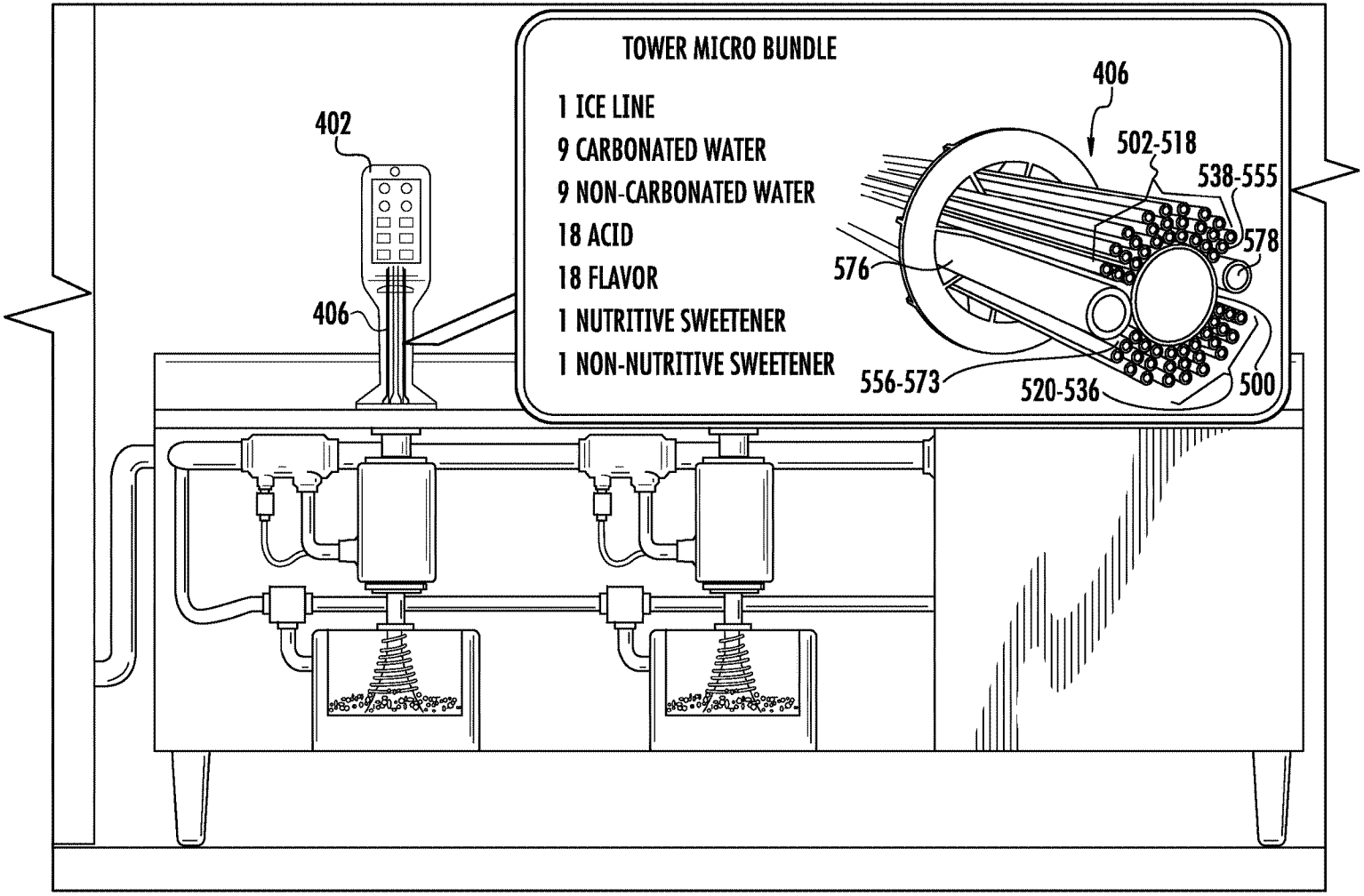
FIG. 5 illustrates an embodiment of a tower micro bundle according to various aspects of the disclosure.

As shown in FIG. 5, dispenser tower 402 may comprise a tower micro bundle 406. In the embodiment depicted, tower micro bundle 406 comprises an ice line 500, nine carbonated water lines 502, 504, 506, 508, 510, 512, 514, 516, 518, nine non-carbonated water lines 520, 522, 524, 526, 528, 530, 532, 534, 536 (including one that may be re-circulated or created on demand, e.g., from the cold water circuit, eighteen flavor lines 538, 539, 540, 541, 542, 543, 544, 545, 546, 547, 548, 549, 550, 551, 552, 553, 554, 555, eighteen acid lines 556, 558, 559, 560, 561, 562, 563, 564, 565, 566, 567, 568, 569, 570, 571, 572, 573, 574, a nutritive sweetener line 576, and a non-nutritive sweetener line 578. Tower micro bundle 406 may comprise any suitable cladding, including slots and piping.

A beverage ingredient, such as a sweetener, may be sent through a micro bundle to get better mixing. Instead of using a traditional ⅜" ID or ¼" ID pipe wherein a sweetener may be dropped to the bottom of a cup and a consumer may not taste the sweetener when drinking a top portion of the beverage in a cup, the present disclosure allows for the use of smaller microtubes to get better mixing and have multiple dispense points (jet it in at a similar rate compared ingredients), and allow for greater dispersion throughout the beverage.

The modular dispensing system may comprise not only a central acid and flavor system, but also a local dairy and/or juice system. Thus, a beverage may be prepared with a shot of juice, e.g., a cola with a shot of lemon juice and/or lime juice. A beverage, such as a cool frappuccino or hot coffee, may be prepared with a shot of a dairy product, e.g., milk or cream.

The modular dispensing system allows for the adding of additional dispenser heads to existing towers for dispensing additional beverages while still using the centralized ingredient system or transfer unit. Such existing towers may be present at drive up systems or in-store systems.

The modular dispensing system may comprise a fast fill system for drive-up applications.

The modular dispensing system may comprise replacement bags for use in ingredient cartridges.

The modular dispensing system may comprise auto sanitizing systems, e.g., auto sanitizing of buttons at dispenser towers 66. The sanitizing system may include a sanitizer cartridge, e.g., a sanitizer cartridge replacing an ingredient cartridge. Those skilled in the art will recognize that locking of a portion of the system may be used so that a sanitizing cycle may be run. For example, a lock out feature with cartridge recognition of the sanitizer may be provided to prevent unintentional beverage dispensing. The lock out feature with cartridge recognition of the sanitizer may have mechanical and electrical safety redundancy.

The modular dispensing system may comprise interlocks on sweetener types.

The modular dispensing system may comprise and/or communicate with a social media system or application. For example, when a mobile device of a consumer is within a predetermined distance from a sensor linked to the modular dispensing system, a message may be sent to the consumer's mobile device that queries the consumer whether the consumer would like to purchase a beverage. Alternatively, or at the same time, a message may appear at a counter location that queries the consumer whether the consumer would like to purchase a beverage. The social media system or application may download to the modular dispensing system the preference or preferences of a consumer based on the consumer's past purchases and/or identified preferences. Thus, the modular dispensing system and/or the social media system or application may query a particular consumer when a mobile device of a consumer is within a predetermined distance from a sensor of the modular dispensing system.

The modular dispenser system may also receive a beverage order from a consumer via a social media system or application, including but not limited to the social media system or application of a seller of beverages, including but not limited to restaurants, theaters, other entertainment venues, and manufacturers and/or distributors of beverages. A consumer may order a beverage prior to arriving at counter so that the drink may be prepared and placed in a cup by the time or close to the time the consumer arrives at the counter. Alternatively, a cup bearing and RFID identifier may be prepared and made available to the consumer for filling by the time or close to the time the consumer arrives at the counter. For example, see U.S. Ser. No. 12/704,217, filed Feb. 11, 2010, published on Aug. 12, 2010 as U.S. Patent Application Publication No. 2010/0200110, which is incorporated herein by reference in its entirety. This system saves time for both consumers and beverage sellers by cutting down on wait time, ordering time, and beverage preparation time.

Thus, the system may recognize an individual and make certain decisions regarding what beverage(s) or type of beverage(s) to offer the individual. The system may change what the system traditionally offers, e.g., a shot of orange juice in a cola beverage, if such a beverage has been ordered by the individual in the past, or the individual has identified the beverage as a preference on social media system or application.

In addition, the system may handle gifts or promotions given from one entity to another. By way of example, but not limitation, the system may recognize an individual, determine whether that individual has received a gift or is eligible for a promotion, and send a query to the individual as to whether the individual will accept the gift or promotion, such as a free beverage or a beverage at a reduced price.

The system may provide a gesture interface so that a user may order a beverage at sensor without touching the sensor.

The system may also provide a sanitizing screen display, including but not limited to, a puff of steam, a wiping motion display, and ultraviolet LED.

The system may provide a user with variable pricing based on brands being sold, e.g., the system may determine what products a user may receive based on cup size.

The system may allow for a user to pull into a drive up location and through the user's mobile device (e.g., a personal digital assistant, cell phone, or smart phone), via telephone or Wi-Fi, Bluetooth or other suitable communication system, know where the user is located and shows the user a menu, and may also provide the user with a special drive up line to pick up an order.

The system may allow for geolocation for advertising due to restricted street sign usage.

The system may provide designs for various fluid flow paths for micro dosing, e.g., controlling drip, and monitoring an effluent side of the pump.

Fast fill may include systems that allow for fast fill from the bottom of a cup.

On-demand carbonation may be provided using the dosing unit.

Figure 6:
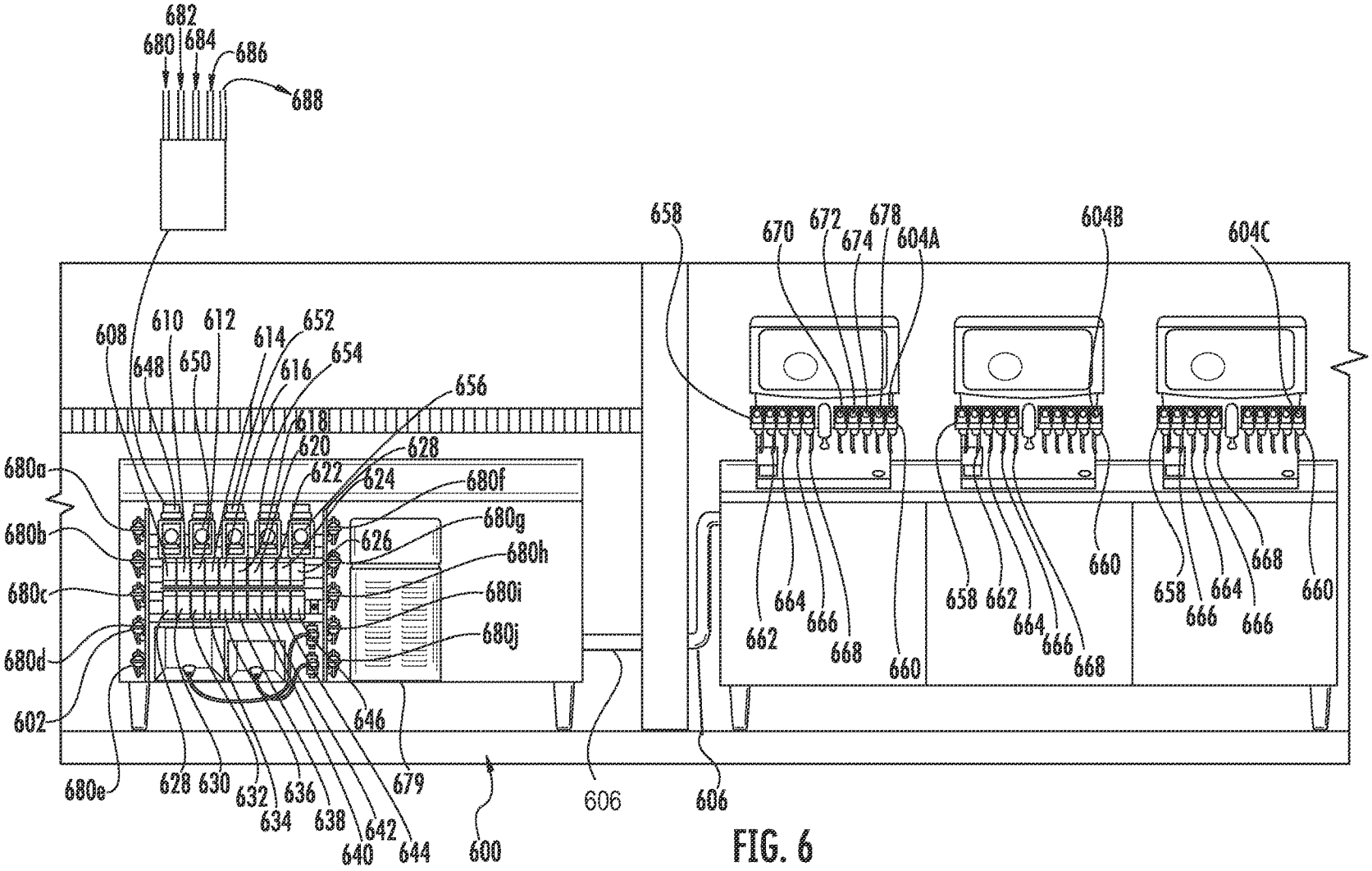
FIG. 6 illustrates an alternative embodiment of a modular dispensing system according to various aspects of the disclosure.
Figure 7:
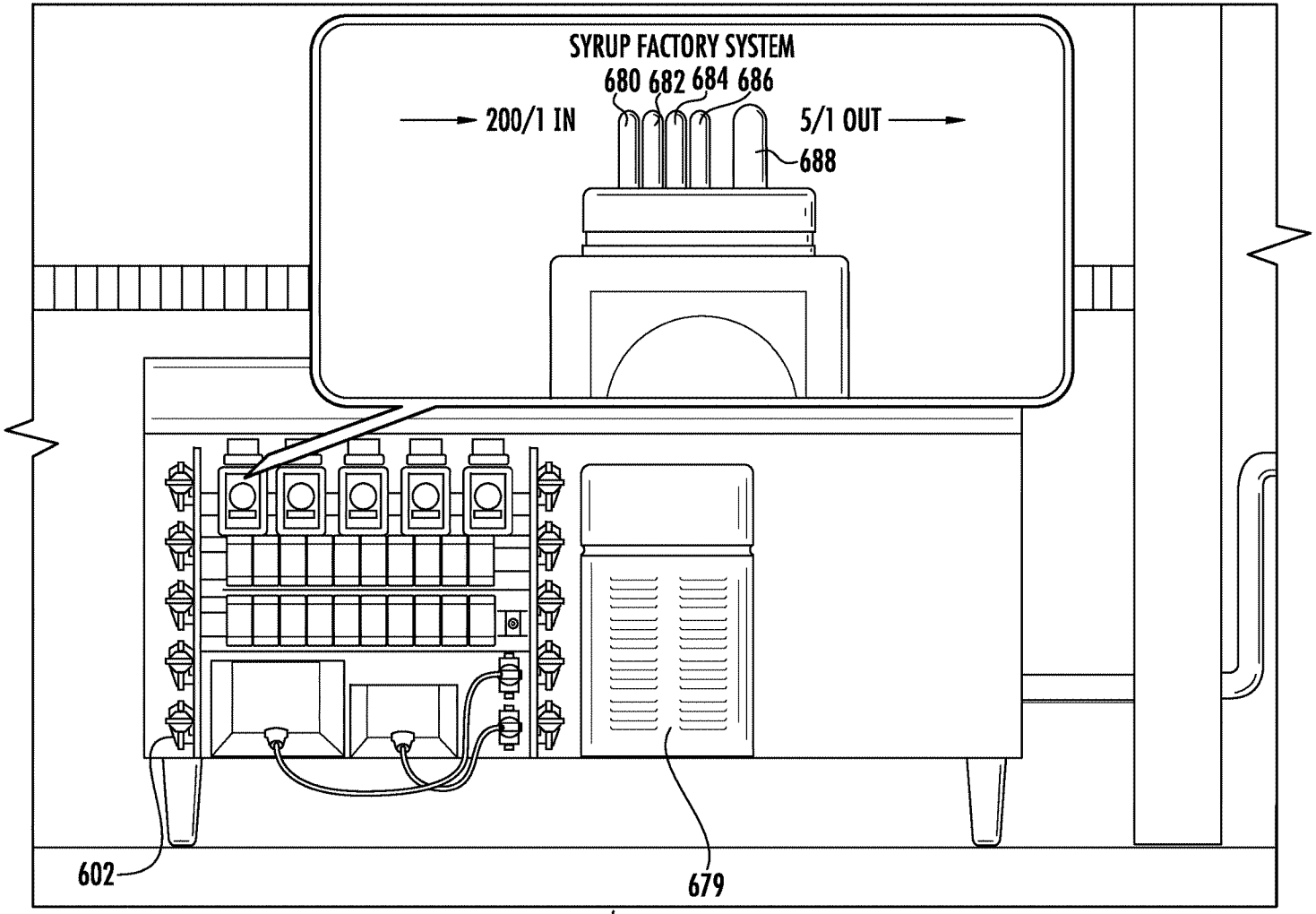
FIG. 7 illustrates an embodiment of centralized ingredient system according to various aspects of the disclosure.

FIGS. 6 and 7 illustrate other aspects of the present disclosure. A transfer unit 600 may be similar to transfer unit 16 previously described. Transfer unit 600 may comprise a water treatment system 134. Transfer unit 600 may optionally comprise an ice system (not shown), like the ice machine 136 previously described.

Transfer unit 600 may comprise a central ingredient system or central reconstitution factory 602, which may be similar to central ingredient system 20 previously described.

Central reconstitution factory system 602 may be linked to one or more conventional or legacy dispensers 604A, 604B, and 604C using a bundle 606. The linking or connection between central reconstitution factory system 602 and legacy dispensers may be achieved in a backroom at the bundle pump inlet connection. As shown in FIG. 6, central reconstitution factory system 602 may comprise a plurality of beverage ingredients. In FIG. 6, central reconstitution factory 602 comprises twenty beverage ingredients 608, 610, 612, 614, 616, 618, 620, 622, 624, 626, 628, 630, 632, 634, 636, 638, 640, 642, 644, 646. These beverage ingredients may be selected from the group consisting of a beverage flavor ingredient and an acid. Transfer unit 600 may comprise one or more mixing chambers. In FIG. 6, transfer unit 600 comprises mixing chambers 648, 650, 652, 654 and 656, and additional mixing chambers if desired. Mixing chamber 648 may correspond to nozzle dispensers 658 and 660 at legacy dispensers 604A, 604B, and/or 604C, mixing chamber 650 may correspond to nozzle dispenser 662 at legacy dispensers 604A, 604B, and/or 604C, mixing chamber 652 may correspond to nozzle dispenser 664 at legacy dispensers 604A, 604B, and/or 604C, mixing chamber 654 may correspond to nozzle dispenser 666 at legacy dispensers 604A, 604B, and/or 604C, and mixing chamber 656 may correspond to nozzle dispenser 658 at legacy dispensers 604A, 604B, and/or 604C. Additional mixing chambers (not shown) may be provided at transfer unit 600 to correspond to nozzle dispensers 670, 672, 674, and 678 at legacy dispensers 604A, 604B, and/or 604C.

Beverage ingredients may be supplied to mixing chambers from cartridges 112 previously described, or bag-in-box type containers, which prior to the present disclosure were typically placed at a beverage dispensing counter.

Syrups and other beverage ingredients may include any of those provided by PepsiCo Inc. to form beverages known under any PepsiCo branded name, such as Pepsi-Cola®. Syrup and other beverage ingredients may be pumped from cartridges 112 or other supply containers by pumps (not shown) to mixing chambers as desired. These pumps may be driven by $CO_2$ from a tank 671 or 673 and supplied through a $CO_2$ gas branch line 675. These pumps may comprise conventional syrup pumps, e.g., BIP pumps.

Each mixing chamber may correspond to a particular beverage to be provided to a nozzle of legacy dispensers 604A, 604B, and/or 604C. In the embodiment shown in FIG. 6, a beverage, e.g., a beverage of regular Pepsi-Cola®, may be formed in mixing chamber 648. Inlets to mixing chamber 648 may comprise a water supply line 680, a sweetener supply line 682, an acid supply line 684, and a flavor supply line 686. Mixing chamber 648 may comprise a beverage out line 688. The sweetener, acid, and flavor ingredients supplied to mixing chamber 648 may be highly concentrated amounts of those ingredients mixed with water prior to being supplied to mixing chamber 648, e.g., a ratio of beverage ingredient to water of about 200 to 1 by weight. After being mixed with water from water supply line 680, the mixture exiting mixing chamber 648 in beverage out line 688 may have a ratio of beverage ingredient to water of about 5 to 1 by weight. Water may be supplied to a mixing chamber from water treatment system 679.

Sweetener line 682 may supply to a mixing chamber a nutritive sweetener and/or a non-nutritive sweetener. Sweetener line 682 may be either a nutritive sweetener pump line 302 or a non-nutritive sweetener pump out line 304 as previously described.

The invention herein has been described and illustrated with reference to the embodiments of the figures, but it should be understood that the features of the invention are susceptible to modification, alteration, changes or substitution without departing significantly from the spirit of the invention. For example, the dimensions, number, size and shape of the various components may be altered to fit specific applications. Accordingly, the specific embodiments illustrated and described herein are for illustrative purposes only and the invention is not limited except by the following claims and their equivalents.

We claim:

1. A modular dispensing system comprising:

at least one dispensing head at a counter, a transfer unit located in a back room remote from the counter, piping extending from the transfer unit to the counter, the transfer unit comprising a centralized ingredient system having a plurality of beverage ingredient sources, the centralized ingredient system configured to supply beverage ingredients to the piping for the dispensing of a first beverage at the counter, the piping comprising a main micro bundle pipe, and a doser unit corresponding to the dispensing head, the doser unit configured to receive from the transfer unit a first beverage ingredient through the main micro bundle pipe, the doser unit located at the counter, wherein the doser unit supplies an appropriate amount of each beverage ingredient through a tower micro bundle, the tower micro bundle comprising an ice line centered in the tower micro bundle configured to convey ice to the dispensing head and a plurality of separate lines bundled around the ice line, with each line corresponding to a particular beverage ingredient.

2. The modular dispensing system of claim 1, wherein the doser unit is located below the counter.

3. The modular dispensing system of claim 1, wherein the transfer unit comprises a water treatment system, the water treatment system configured to treat water entering the water treatment system so that it has at least one predetermined characteristic upon exiting the water treatment system.

4. The modular dispensing system of claim 3, wherein the at least one predetermined characteristic of the water upon exiting the water treatment system is a temperature that is lower than the temperature of the water entering the water treatment system.

5. The modular dispensing system of claim 3, wherein the at least one predetermined characteristic of the water upon exiting the water treatment system is a temperature that is higher than the temperature of the water entering the water treatment system.

6. The modular dispensing system of clam 3, wherein the main micro bundle pipe comprises a line from the water treatment system to the dispensing head.

7. The modular dispensing system of claim 1, wherein the transfer unit comprises an ice machine.

8. The modular dispensing system of claim 7, wherein the main micro bundle pipe comprises a line from the ice machine to the dispensing head.

9. The modular dispensing system of claim 8, wherein the dispensing head is configured to dispense ice from the main micro bundle pipe.

10. The modular dispensing system of claim 1, wherein the dispensing head is configured to receive ice from an ice hopper and dispense the ice in a predetermined amount along with the other beverage ingredients.

11. The modular dispensing system of claim 10, wherein the ice hopper is located at the counter.

12. The modular dispensing system of claim 11, wherein the ice hopper is located below the counter.

13. The modular dispensing system of claim 1, wherein the dispensing head is configured to receive at least one carbonated water line and dispense carbonated water in a predetermined amount along with the other beverage ingredients.

14. The modular dispensing system of claim 1, wherein the dispensing head is configured to receive at least two beverage ingredients, the at least two beverage ingredients selected from the group consisting of a flavor ingredient and an acid.

15. A modular dispensing system comprising:

at least a first dispensing head and a second dispensing head at a counter, a transfer unit located in a back room remote from the counter, piping comprising a main micro bundle pipe, the main micro bundle located downstream of the transfer unit and extending from the transfer unit to the counter, the transfer unit comprising a central reconstitution factory system, the central reconstitution factory system comprising at least a first mixing chamber corresponding to a first predetermined beverage, and at least a second mixing chamber corresponding to a second predetermined beverage, the central reconstitution factory configured to combine water with at least a first highly concentrated beverage ingredient corresponding to a first beverage in the first mixing chamber to form a first reconstituted mixture, the central reconstitution factory configured to combine water with at least a second highly concentrated beverage ingredient corresponding to a second beverage in the second mixing chamber to form a second reconstituted mixture, wherein the main micro bundle pipe comprises a first reconstituted mixture line configured to convey the first reconstituted mixture to a first dispensing head, and a second reconstituted mixture line configured to convey the second reconstituted mixture to the second dispensing head, wherein the first mixing chamber comprises separate first, second, third and fourth inlets, wherein the first inlet corresponds to a first water supply line, the second inlet corresponds to a first sweetener supply line, the third inlet corresponds to a first acid supply line, and the fourth inlet corresponds to a first flavor supply line, wherein the second mixing chamber comprises separate first, second, third and fourth inlets, wherein the first inlet corresponds to a second water supply line, the second inlet corresponds to a second sweetener supply line, the third inlet corresponds to a second acid supply line, and the fourth inlet corresponds to a second flavor supply line.

16. The modular dispensing system of claim 15, wherein the at least one highly concentrated beverage ingredient has a ratio of beverage ingredient to water of about 200 to 1 by weight.

17. The modular dispensing system of claim 16, wherein the reconstituted mixture exiting the mixing chamber has a ratio of the at least one beverage ingredient to water of about 5 to 1 by weight.

18. The modular dispensing system of claim 15, wherein the first dispensing head is a component of a first legacy dispenser and the second dispensing head is a component of a second legacy dispenser.

19. The modular dispensing system of claim 18, wherein the at least one highly concentrated beverage ingredient has a ratio of beverage ingredient to water of about 200 to 1 by weight.

20. The modular dispensing system of claim 19, wherein reconstituted mixture exiting the mixing chamber has a ratio of the at least one beverage ingredient to water of about 5 to 1 by weight.

21. The modular dispensing system of claim 1, wherein the system is configured to dispense a first beverage at the first counter according to a consumer preference communicated from a social media system.

22. The modular dispensing system of claim 1, wherein the system is configured to send a query to a consumer within a predetermined distance from the modular dispensing system to query the consumer whether the consumer would like to purchase a beverage.

23. The modular dispensing system of claim 22, wherein the query is based upon one of a preference of a consumer, a past purchase of the consumer, an identified preference of a consumer, and a geographic location of the consumer.

24. The modular dispensing system of claim 1, wherein the system is configured to receive a beverage order from a consumer via a social media system or application.

* * * * *